US005839252A

United States Patent [19]

Berghorn et al.

[11] Patent Number: 5,839,252

[45] Date of Patent: Nov. 24, 1998

[54] METAL DOOR WITH CONTINUOUS FRAME AND METHOD

[75] Inventors: David M. Berghorn, Waterford; Shaojun Gao, Detroit, both of Mich.

[73] Assignee: The Stanley Works, New Britain, Conn.

[21] Appl. No.: 835,143

[22] Filed: Apr. 4, 1997

[51] Int. Cl.[6] ..... E04C 2/34; E06B 3/76

[52] U.S. Cl. ..... 52/784.13; 52/475.1; 52/479; 52/658; 52/745.15; 52/745.19; 52/780; 52/784.1; 52/784.15

[58] Field of Search ..... 52/784.15, 784.1, 52/784.12, 784.13, 745.15, 745.19, 475.1, 481.2, 479, 780, 658

[56] References Cited

U.S. PATENT DOCUMENTS

| | | | |
|---|---|---|---|
| 1,018,896 | 2/1912 | Frey | 52/784.15 X |
| 1,801,080 | 4/1931 | Hart et al. | 52/784.13 X |
| 1,873,417 | 8/1932 | Jones | 52/784.13 X |
| 2,780,845 | 2/1957 | Chapman et al. . | |
| 2,862,257 | 12/1958 | Comer . | |
| 3,153,817 | 10/1964 | Pease, Jr. | 52/784.13 |
| 3,334,464 | 8/1967 | Charles . | |
| 3,364,645 | 1/1968 | Wenzelberger . | |
| 3,423,878 | 1/1969 | Kimmel . | |
| 3,426,482 | 2/1969 | Mock . | |
| 3,479,770 | 11/1969 | Mock . | |
| 3,690,037 | 9/1972 | Kempel . | |
| 3,786,613 | 1/1974 | Shepheard | 52/784.13 |
| 3,796,008 | 3/1974 | Eakin . | |
| 4,295,299 | 10/1981 | Nelson . | |
| 4,752,517 | 6/1988 | Beitel . | |
| 4,896,458 | 1/1990 | McKann et al. | 52/784.13 X |

*Primary Examiner*—Christopher Kent
*Attorney, Agent, or Firm*—Pepe & Hazard LLP

[57] ABSTRACT

A metal door has a unitary rectangular frame of generally uniform cross section providing stiles and rails, and a pair of substantially rectangular panels which are secured to the frame. The panels have opposed flanges overlying and engaged with the adjacent side margins of the stiles of the frame to secure the panels thereto. The door is fabricated by forming an elongate metal strip into a frame element of generally uniform cross section with channels between a generally planar central portion and inwardly offset marginal portions. A predetermined length of the strip is bent to form a substantially rectangular frame, the ends of which are fastened together. The panels have lips on their flanges and are assembled to the frame with the flanges inserted into the channels and the lips frictionally engaging the side walls thereof.

21 Claims, 10 Drawing Sheets

THE COIL BLANK

PRE-NOTCHING, PRE-PUNCHING

ROLL FORMING

EMBOSSING AND POST-NOTCHING

FLY-CUTTING AND BENDING

METAL DOOR WITH CONTINUOUS FRAME AND METHOD

BACKGROUND OF THE INVENTION

The present invention pertains to doors and, more particularly, to doors comprising a pair of opposed metal panels affixed to a peripheral frame, and to a method for making such doors.

Metal entry and fire doors with insulating cores have enjoyed substantial popularity due to their strength and to their temperature and sound insulating qualities and, when utilized with metal wall frames, due to their fire resistance. One drawback to such doors, however, is that the process of producing them is generally comparatively labor intensive and involves multiple steps. In addition to the direct costs of the labor involved, the manufacturing process can result in variability in the dimensions of the product and in poor joints. This results in waste, scrap and rejected units, all of which further increase the cost of the marketable units.

It is a primary object of the present invention to provide novel metal entry and fire doors which are strong, durable and economical to produce.

A further object is to provide such doors which may be accurately produced to minimize rejects and to provide ease of installation.

Another object of the invention is to provide a novel method for making such entry and fire doors with increased efficiency and economy in a manner suitable for commercial mass production.

SUMMARY OF THE INVENTION

It has now been found that the foregoing and related objects may be readily attained in a metal door comprising a substantially rectangular frame with stiles and rails, and a pair of substantially rectangular panels engaged with the frame. The frame is provided by a continuous, unitary metallic member of generally uniform cross section, and the panels have opposed flanges extending along the sides thereof which overlie and engage with the adjacent side margins of the stiles of the frame to secure the panels thereto.

Generally, the door includes an insulating core of cellular synthetic resin substantially filling the space between the panels and the frame.

The cross section of the metallic frame member has a generally planar central portion and marginal portions extending along the sides thereof. The marginal portions are inwardly offset from the plane of the central portion, and the flanges of the panels extending thereover. Desirably, channels are provided between the marginal portions and the central portion, and the flanges of the panels have inturned lips extending thereinto. Preferably, the width of the channels is greater than twice the thickness of the panels, and the lips have reversely extending angularly oriented segments along their free edges which functionally engage the side walls of the channels.

In the preferred embodiment, the cross section of the frame member includes inwardly directed tail portions which extend from the outer sides of the marginal portions and extend in spaced relationship along the inner surface of the panels. The tail portions include distal segments inclined at an angle to the plane of the panels of not more than about 30°. The cellular synthetic resin of the core extends between the body of the tail portions and their distal segments and the metal panels to secure the panels to the frame and provide insulation therebetween.

The frame member has overlapping end portions which are engaged, and these are conveniently disposed along the bottom rail. The top and bottom of the panels also have opposed flanges overlying the rails of the frame.

In the method of fabricating the metal door, an elongate metal strip is provided with a contoured and generally uniform cross section and the strip is bent to form a substantially rectangular frame with stiles and rails with overlapping ends being fastened. A pair of substantially rectangular panels have flanges extending along the side edges thereof and are assembled onto the frame with the flanges overlying and engaged with the adjacent side margins of the stiles to secure the panels to the frame.

Preferably, the frame is squared with the panels snapped thereon and edge portions of the panels are bent over the frame to lock the assembled door in the squared condition.

BRIEF DESCRIPTION OF THE DRAWINGS

The present invention will be more clearly understood from the following description together with the attached drawings in which.

DETAILED DESCRIPTION OF THE PREFERRED EMBODIMENT

Figures 1, 2, 3:
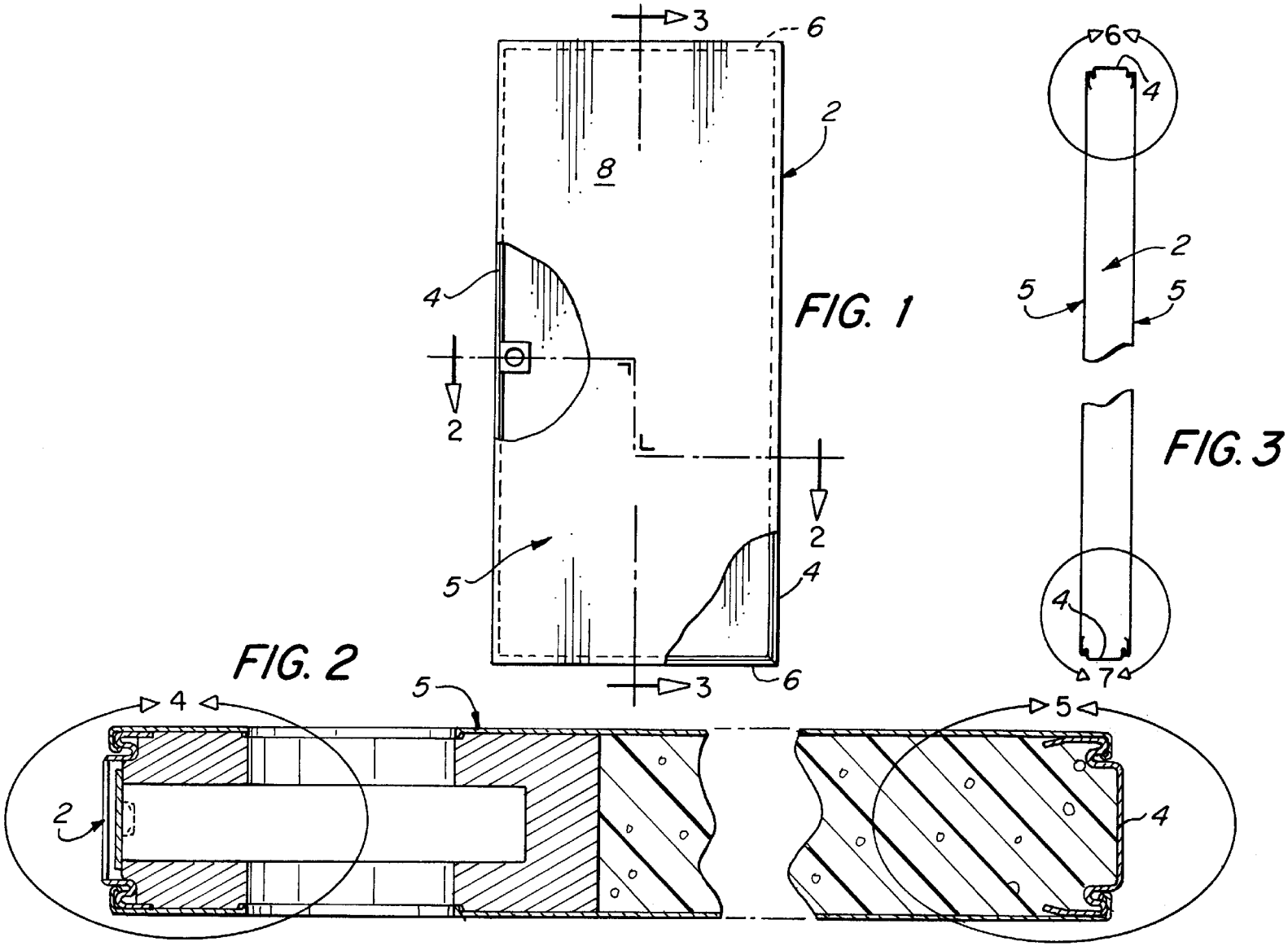
FIG. 1 is a front elevational view, partly broken away, of a door embodying the present invention.
FIG. 2 is a cross sectional view taken along line 2—2 of FIG. 1.
FIG. 3 is a cross sectional view taken along line 3—3 of FIG. 1 and drawn to an enlarged scale to illustrate the foam layers between the tail of the frame and the panel.

Turning first to FIG. 1, a door embodying the present invention has a unitary rectangular frame 2 with a pair of substantially rectangular panels 5 secured thereto and a core 3 of cellular synthetic resin filling the cavity.

Figure 8:
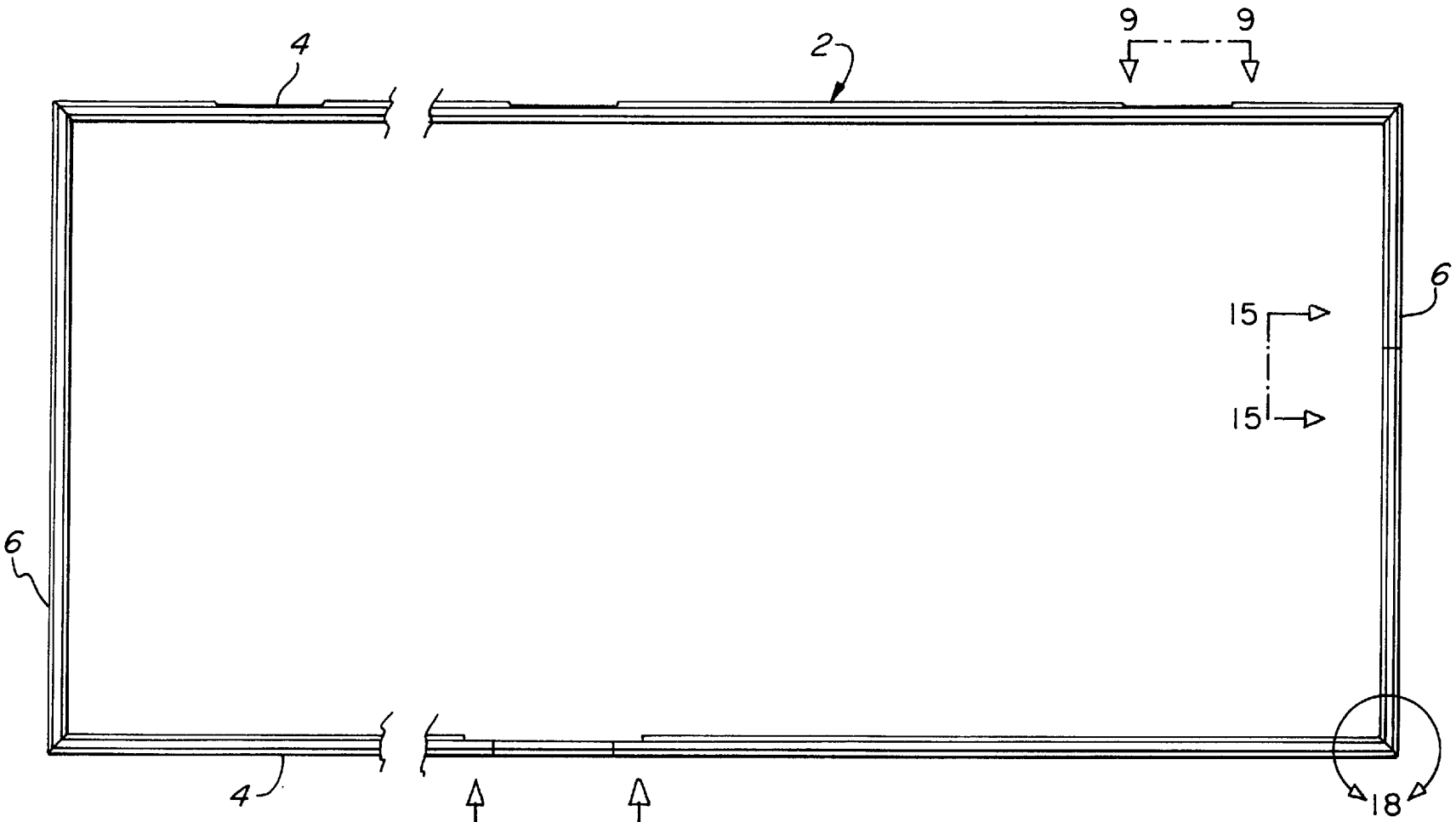
FIG. 8 is a front elevational view of the frame of the door of FIG. 1.
Figure 11:
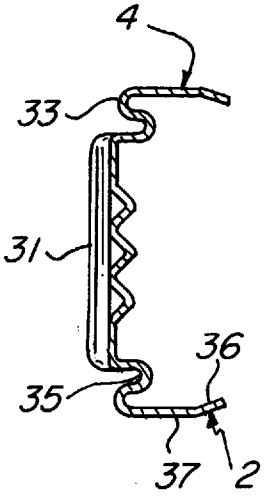
FIG. 11 is a cross sectional view taken along line 11—11 of FIG. 9.
Figure 9:
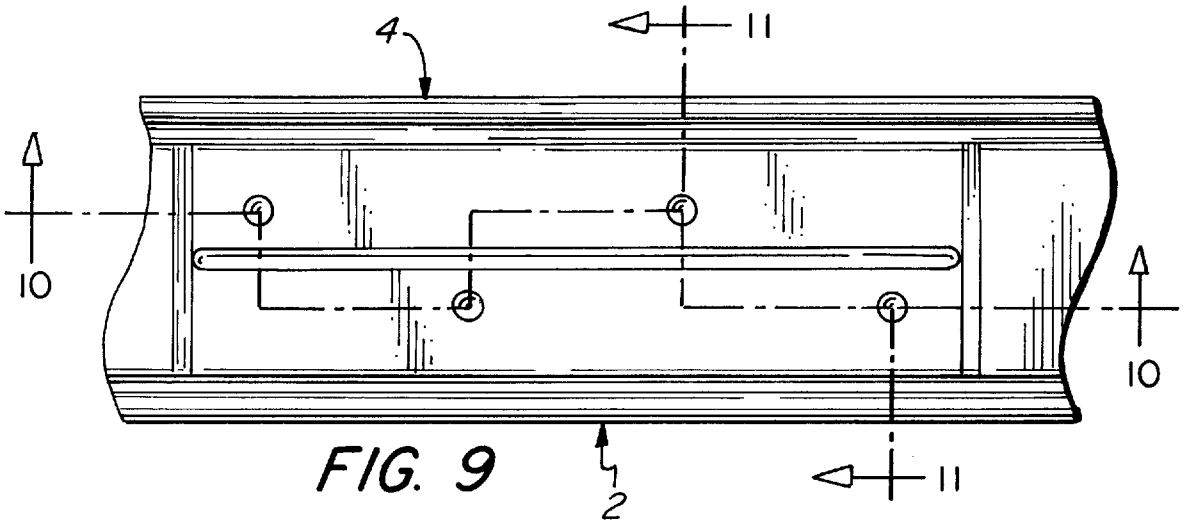
FIG. 9 is a fragmentary front view of the area 9—9 of FIG. 8.
Figure 10:
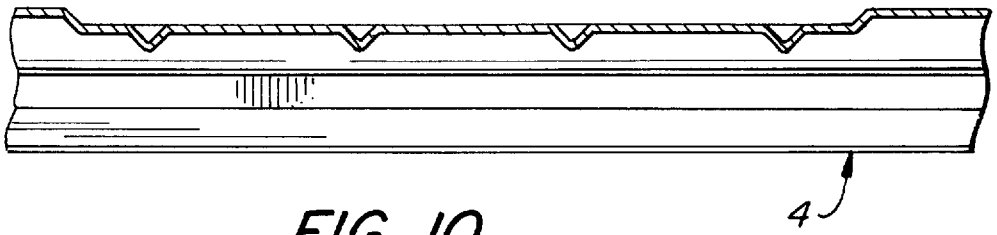
FIG. 10 is a fragmentary cross sectional view taken along line 10—10 of FIG. 9.
Figure 17:
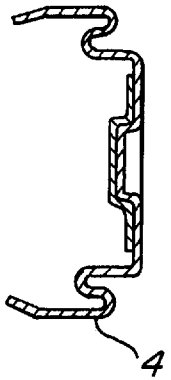
FIG. 17 is a cross sectional view taken along line 17—17 of FIG. 15.
Figure 18:
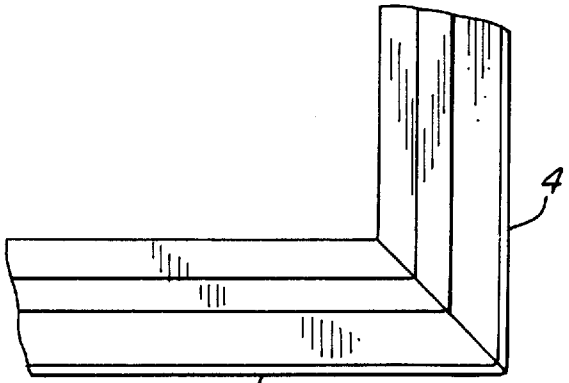
FIG. 18 is an enlarged fragmentary view of Detail 18 of FIG. 8.
Figure 15:
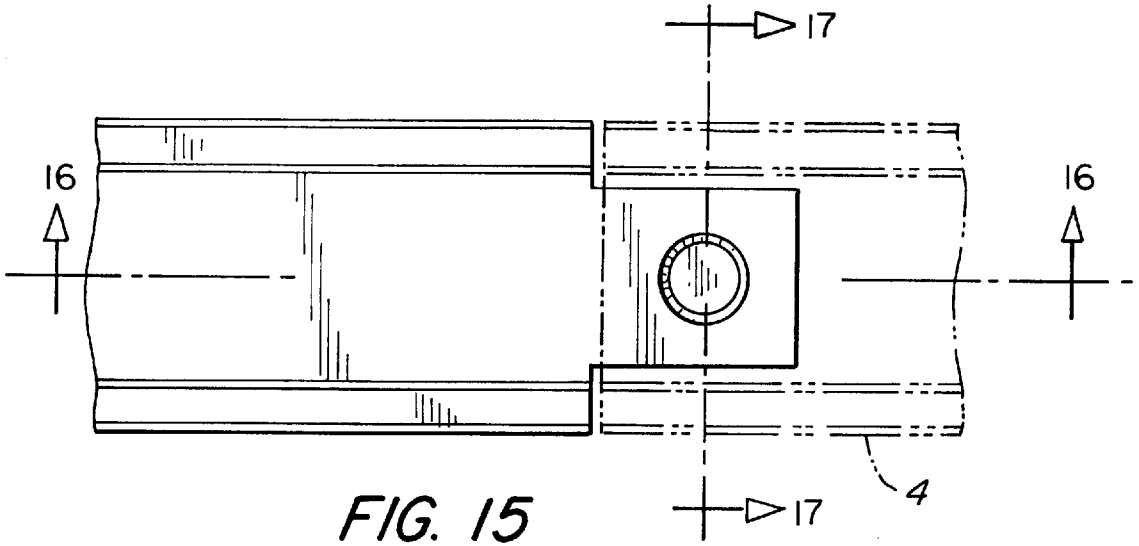
FIG. 15 is a fragmentary side view of area 15—15 of FIG. 8.
Figure 16:
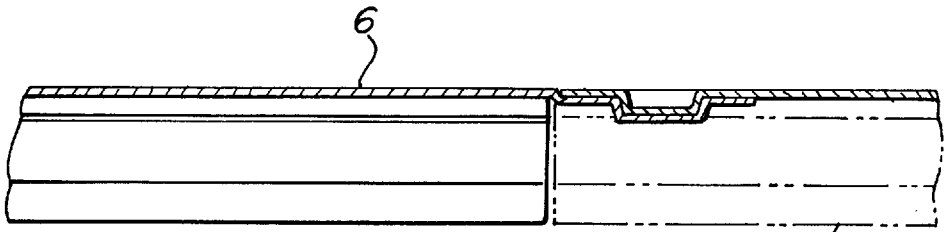
FIG. 16 is a fragmentary cross sectional view taken along line 16—16 of FIG. 15.

As best seen in FIG. 8, the frame 2 is a continuous unitary metallic member of generally uniform cross section which includes a pair of parallel stiles 4 and upper and lower rails 6. Preferably, the ends of the frame 2 are joined in the middle of lower rail 6 as seen in FIGS. 15–17.

Figure 13:
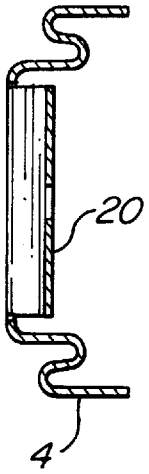
FIG. 13 is a cross sectional view taken along line 13—13 of FIG. 12.
Figure 12:
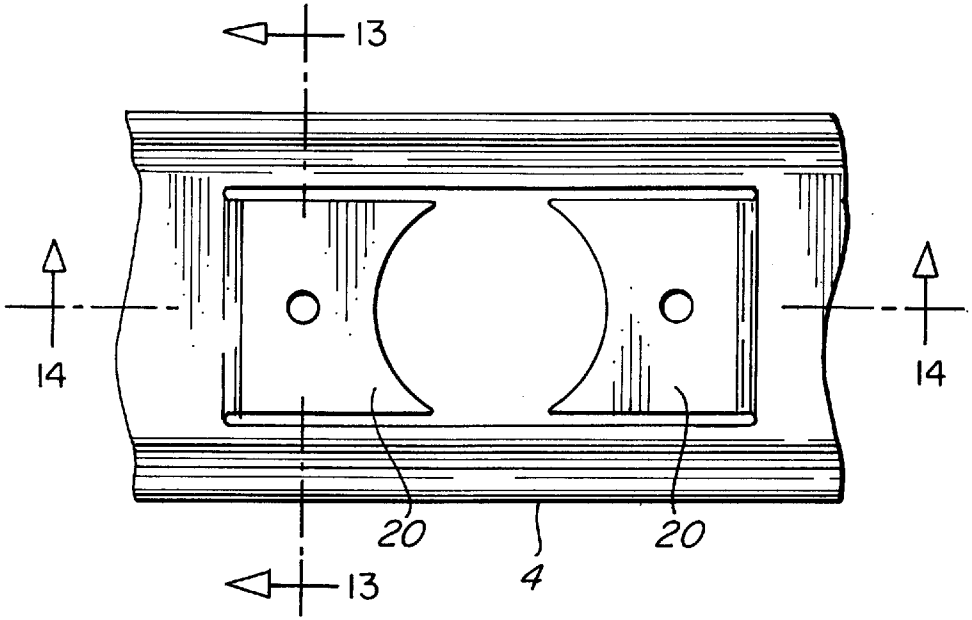
FIG. 12 is a fragmentary side view of area 12—12 of FIG. 8.
Figure 14:
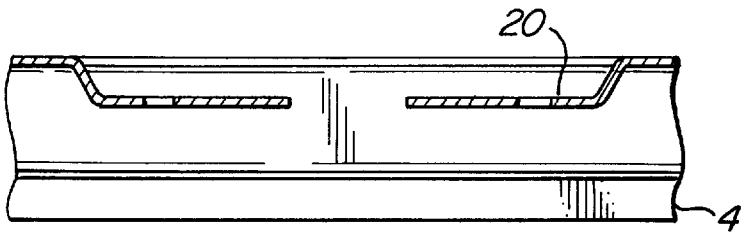
FIG. 14 is a fragmentary cross sectional view taken along line 14—13 of FIG. 12.

As best seen in FIGS. 4–7, the frame cross section includes a planar central portion 31, a pair of flanking marginal portions 33 which are inwardly offset from the plane of central portion 31, and a pair of channels 35 between the marginal portions 33 and central portion 31. The marginal portions 33 have inwardly directed flanges or tail portions 37 along their outer edges and distal segments 34 on the ends of the tail portions 37 extend inwardly at an angle of about 17.5° to the body of the tail portion. It is to be noted that the frame member cross section is generally symmetrical along its length. As illustrated in the drawings, various recesses and openings are provided at appropriate locations on the stiles 4 for the attachment of hinges (not shown) and a lockset and/or dead bolt (not shown). As seen in FIGS. 5, 10, 11, 16 and 17, the metal of the strip may be punched to provide dimples which will seat the fasteners (not shown) for securing the hinges and locksets. FIGS. 12–14 show the lockset area with an embossed recess 20. An opening may also be formed in a rail 6 for the insertion of a foamable resin to provide the core 3 hereinafter described. All of these recesses and openings are in central portion 31 of the frame element.

Figure 5:
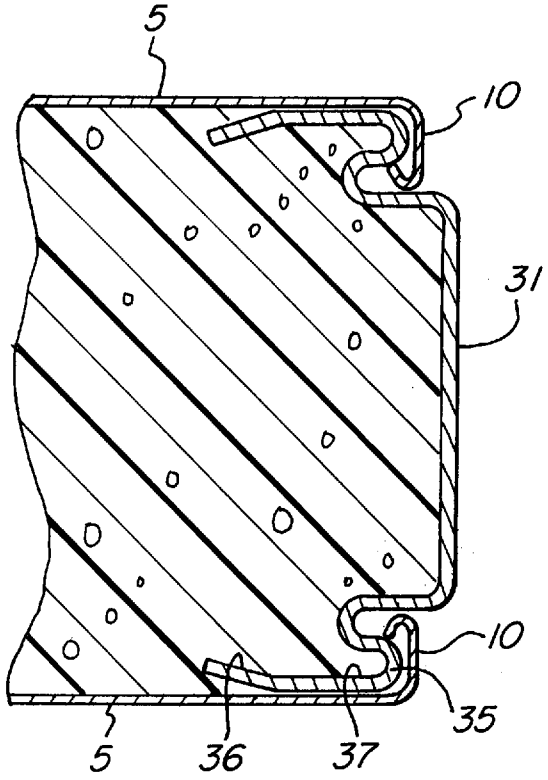
FIG. 5 is an enlarged fragmentary sectional view of detail 5 in FIG. 2.
Figure 4:
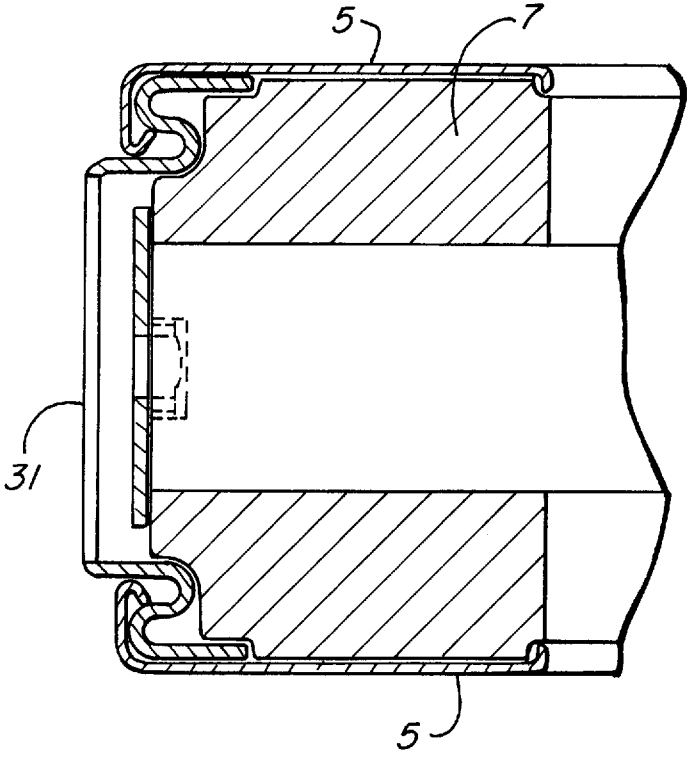
FIG. 4 is an enlarged fragmentary sectional view of detail 4 in FIG. 2.
Figure 6:
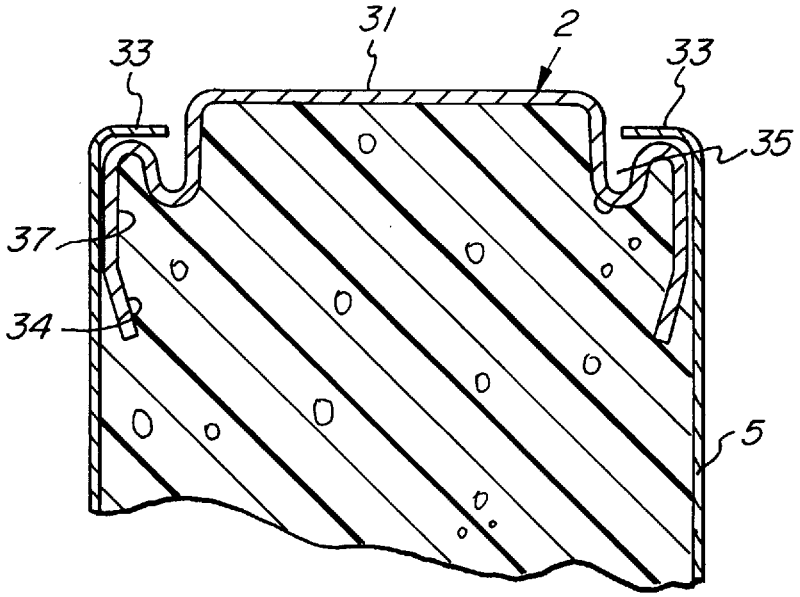
FIG. 6 is an enlarged fragmentary sectional view of detail 6 in FIG. 3.
Figure 7:
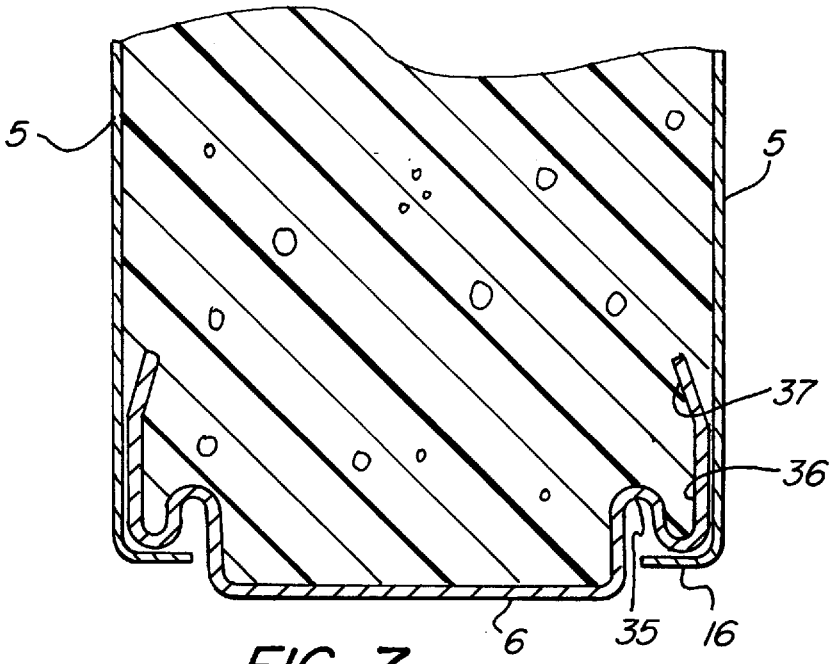
FIG. 7 is an enlarged fragmentary sectional view of detail 7 in FIG. 3.
Figure 19:
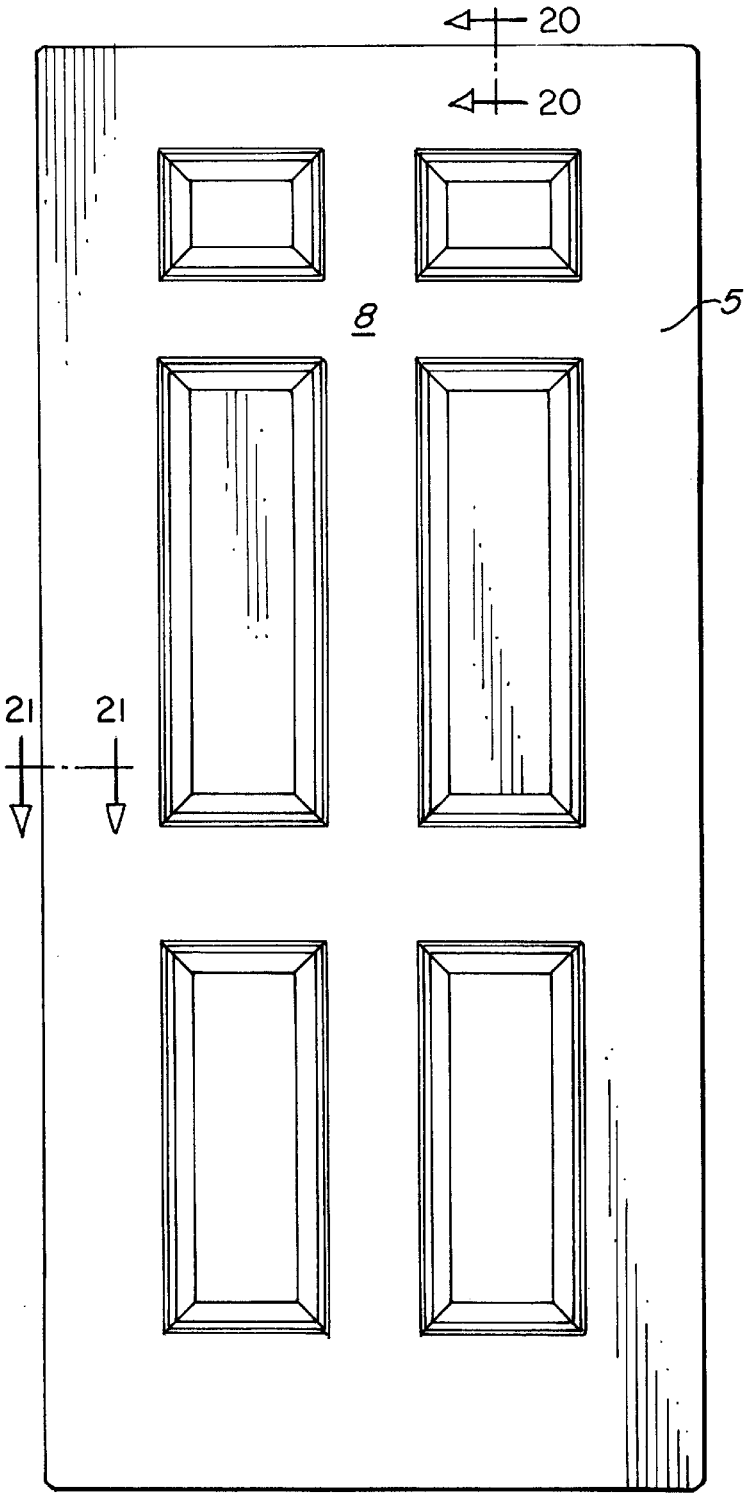
FIG. 19 is a front view of one embodiment of a door panel in accordance with the present invention.
Figure 20:
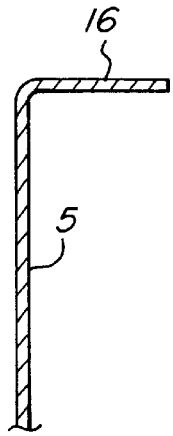
FIG. 20 is an enlarged fragmentary cross sectional view taken along line 20—20 of FIG. 19.
Figure 21:
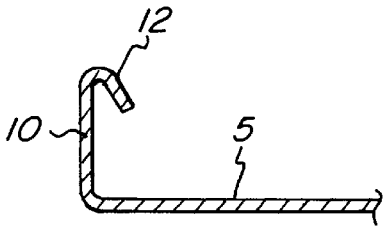
FIG. 21 is an enlarged fragmentary cross sectional view taken along 21—21 of FIG. 19.
Figure 22A:
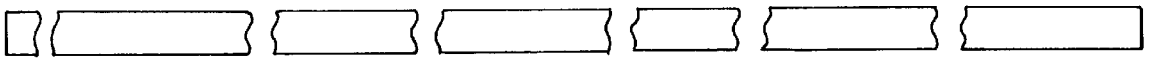
FIGS. 22A, 22B, 22C, 22D, 22E and 22F comprise a series of partially diagrammatic views illustrating the steps in forming the door frame of FIG. 8.
Figure 22B:
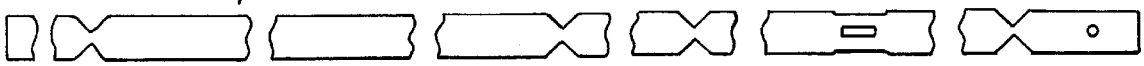
Figure 22C:
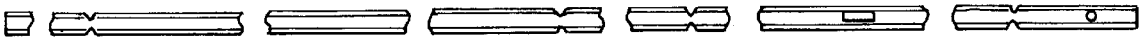
Figure 22D:
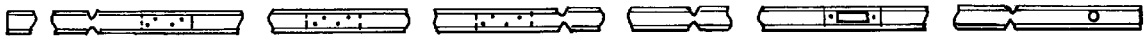
Figure 22E:
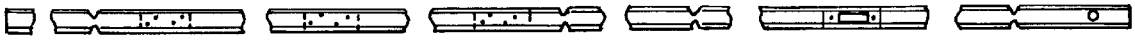
Figure 22F:
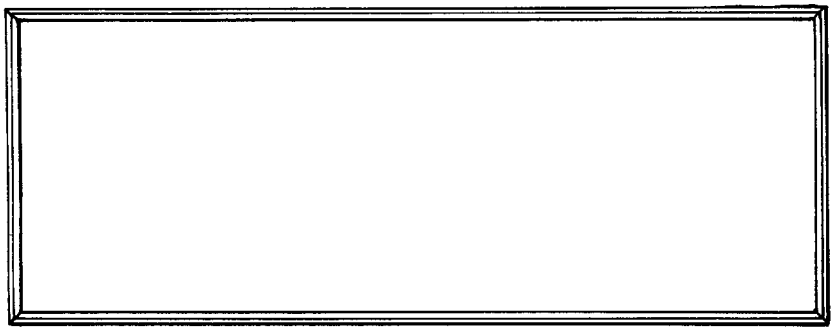
Figure 23A:
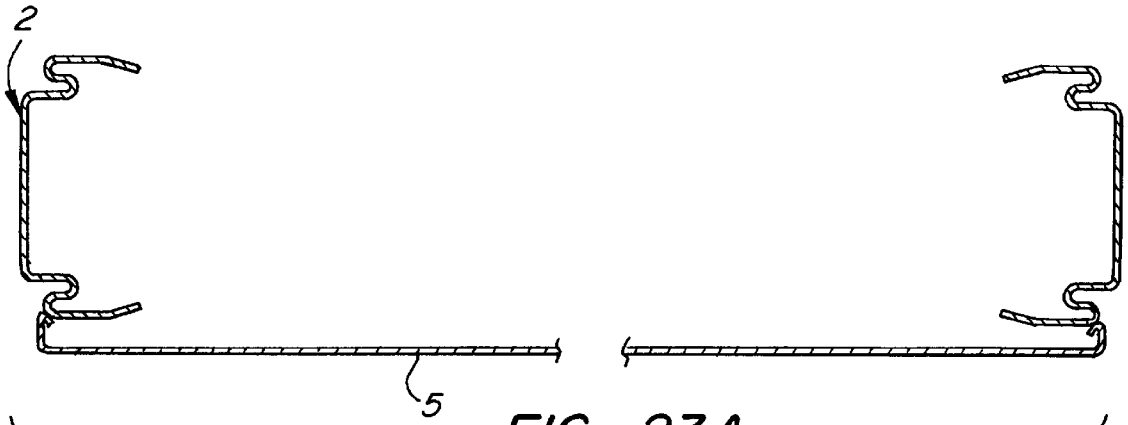
FIGS. 23A, 23B and 23C comprise series of partially diagrammatical, cross sectional views illustrating the panels being assembled onto the frame of FIG. 8.
Figure 23B:
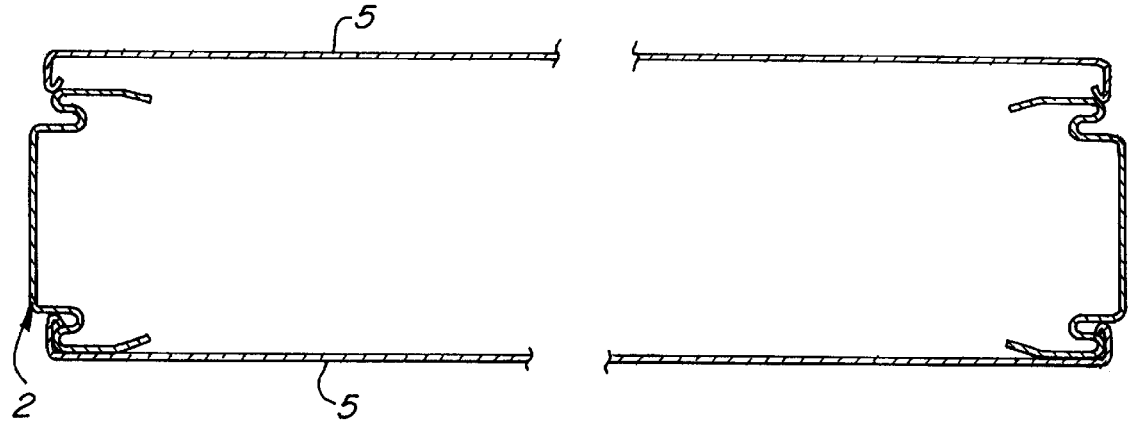
Figure 23C:
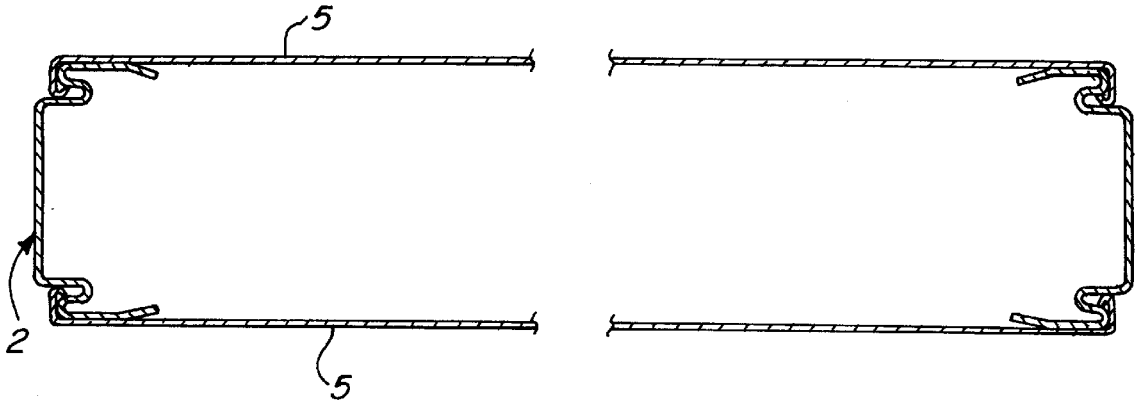

As best seen in FIG. 19, the metallic panel 5 is generally planar and rectangular, and it may have an embossed face 8 as seen therein. As seen in FIGS. 4 and 5, the edges of the longer sides of the panel 5, i.e., the sides which will be vertical when the door is installed, have flanges 10 extending at a right angle to the plane of the face 8 of the panel 5 and these seat in the channels 35 of the stiles 4. As also seen, the ends of the flanges 10 have reversely and inwardly bent segments 12 which deflect when the flanges 10 are inserted into the channels 35. This produces a snap fit and frictional engagement with the sidewalls of the channels 35 to secure the panels 5 on the frame 2. The edges of the shorter side of panels 5, i.e., the sides which will be horizontal when the door is installed also have flanges 16 which extend at a right angle to the face and these seat on the surface of the marginal portions 33 of the upper and lower rails 6 of the frame 2 and serve both to prevent the panels 5 from sliding vertically on the frame 2 and to prevent deformation of the door from its desired rectangular configuration.

Backing blocks 7 of wood or plastic may be placed within the door frame 2 to support a lockset (not shown) and to provide backing for the attachment of hinges or other items such as emergency closures and handles (not shown) in a conventional manner. The remainder of the space bounded by the frame 2 and panels 5 is filled with a cellular synthetic resin core 3. If the core 3 is provided by introducing beads or pellets which are expanded or in place by heat, the expanding material of the core 3 extends between and engages the tail portions 27 and the inwardly projecting distal segments 12 of the frame 2, further serving to strengthen and rigidify door 1 as well as to provide insulation therebetween. The 17.5° inward inclination of the distal segments 37 has been found to maximize this engagement.

As diagrammatically illustrated in FIG. 22, the frame 3 of the door may be formed in a single piece from a coil of metal strip of suitable thickness and width. The strip is first prenotched and prepunched and then roll formed into the desired cross section. The roll formed strip is next embossed with the desired recesses and notched, and finally cut into desired lengths. These lengths are bent at the notches which are located at the corners to form the desired rectangular shape.

The ends of the frame element are then fastened together to complete the frame 2. As seen in FIGS. 15–17, the ends 18 of the length of strip providing the frame 2 may overlap and be secured by clenching or staking (not shown) or by any other suitable means such as the insertion of a tongue into a slot, welding, rivets, etc.

To assure optimum engagement between the frame 2 and the panels 5, the width of channels 35 is greater than twice the thickness of the panels 5 so that the angularly oriented segments 12 snap fit therein and be retained therein.

This assembly of the panels 5 to the frame 2 begins with the positioning of a first panel 5 on an assembly table with the flanges 10, and top flange 16 extending upwardly. The frame 2 is placed atop the prepositioned panel 5 and pressed downwardly, causing the channel flanges 10 to enter into the channels 35 and deflect the segments 12 which the snap fit and frictionally engage the channel walls. The top and bottom edges have perpendicular flanges 33 which snugly fit over the rails 6.

A second panel 5 is now placed on the frame 2 and pressed downwardly into engagement therewith in the same fashion. In one embodiment, the bottom portions of both panels 5 may be bent to provide the bottom flanges 16 which extend over the surface of the bottom rail 6 to lock the assembly in a squared condition.

Lastly, the cellular synthetic resin core 3 may be provided in a conventional manner by introducing, through an opening in the frame, a foamable fluid synthetic resin into the cavity and foaming it in place or by inserting prefoamed plastic beads into the door interior through an opening previously formed in the frame 3 and applying heat to cause the beads to expand. Alternatively, the core 3 may be produced by an open pour process in which the resin is introduced before the top panel is placed thereon and the top panel placed thereon, after which the resin cures fully.

Thus, it can be seen from the foregoing detailed specification and attached drawings that the metal door of the present invention is readily and easily fabricated with a minimum of assembly labor and steps. The continuous frame eliminates many of the problems encountered by assembling separate stiles and rails.

Having thus described the invention, what is claimed is:

1. A metal door comprising a continuous substantially rectangular frame with stiles and rails, and a pair of substantially rectangular panels engaged with said frame, said frame comprising an integrally formed continuous, unitary metallic frame member of generally uniform cross section with marginal portions extending along the sides thereof and channels in its outer face extending along said side marginal portions, said panels having opposed flanges extending along the sides thereof overlying and adjacent said marginal portions of said stiles of said frame and engaged in said channels to secure said panels thereto.

2. The metal door of claim 1 wherein said panels and frame enclose a cavity and said door includes an insulating core of cellular synthetic resin substantially filling said cavity between said panels and said frame.

3. The metal door of claim 1 wherein said cross section of said metallic frame member has a generally planar central portion and said marginal portions extend along said sides thereof and are inwardly offset from the plane of said central portion, said flanges of said panels extending over said marginal portions.

4. The metal door of claim 3 wherein said channels are provided on said frame member between said marginal portions and said central portion, and wherein said flanges of said panels have lips extending thereinto.

5. The metal door of claim 4 wherein the width of said channels is greater than twice the thickness of said lips of said panels.

6. The metal door of claim 5 wherein said lips on said panel flanges have reversely bent angularly oriented segments along their ends which are deflected upon insertion into said channels and frictionally engage the walls of said channels.

7. The metal door of claim 4 wherein said cross section of said frame member further includes inwardly directed tail portions extending along the outer edges of said marginal portions spaced from said central portion, said tail portions extending along the inner surface of said panels.

8. The metal door of claim 7 wherein said tail portions include distal segments inclined at an angle to the plane of said panels of not more than 30°.

9. The metal door of claim 8 further including a core of cellular synthetic resin disposed within said frame and between said panels, said core extending between said tail portions and distal segments of said metal frame member material to secure said panels to said frame and provide insulation therebetween.

10. The metal door of claim 1 wherein said frame member has overlapping end portions which are engaged.

11. The metal door of claim 10 wherein said frame has top and bottom rails and has overlapping portions along said bottom rail.

12. The metal door of claim 1 wherein said panels have opposed flanges overlying said rails of said frame.

13. In a method of fabricating a metal door, the steps comprising:

(a) providing an elongate metal strip with a contoured and generally uniform cross section, said cross section providing marginal portions along said sides thereof and channels in one face extending along the sides thereof;

(b) bending said length of said contoured strip to form a unitary, substantially rectangular frame with stiles and rails, said channels being disposed on its outer face;

(c) forming a pair of substantially rectangular panels with flanges extending along the side edges thereof; and (e) assembling said panels on said frame with said flanges overlying and adjacent said marginal portions of said stiles and engaging in said channels to secure said panels to said frame.

14. The method of fabricating a metal door in accordance with claim 13 wherein said strip providing step includes forming a tail portion along the side edge of said strip and said panels overlie said tail portions.

15. The method of fabricating a metal door in accordance with claim 14 including the steps of:

(a) filling the cavity defined between said frame and said panels with a synthetic resin material; and (b) expanding said synthetic resin to substantially fill said cavity.

16. The method of fabricating a metal door in accordance with claim 15 wherein said step of filling said cavity includes introducing a foamable synthetic resin formulation into said space and foaming said resin formulation in said cavity.

17. The method of fabricating a metal door in accordance with claim 16 wherein said resin introduction step causes resin to extend between said tail portion and said panels to provide insulation therebetween.

18. The method of fabricating a metal door in accordance with claim 13 wherein said strip providing step provides a cross section with a generally planar central portion and side marginal portions extend in a plane offset from that of said central portion, said channels being disposed between said marginal portions and central portion.

19. The method of fabricating a metal door in accordance with claim 18 wherein said strip providing step includes providing holes in said strip and providing recesses for seating hardware.

20. The method of fabricating a metal door in accordance with claim 18 wherein said panel forming step provides lips along the ends of said flanges and said assembling step snaps said lips into said channels.

21. The method of fabricating a metal door in accordance with claim 13 wherein there is included the step of fastening overlying end portions of said bent frame.

* * * * *